106-74 AU 115 EX

10/24/78 OR 4,121,942

United States Patent [19]

Kato

[11] 4,121,942

[45] Oct. 24, 1978

[54] MOLDING METHOD

[76] Inventor: Asamichi Kato, 7020 Oaza Koga, Koga-City, Ibaragi-Pref., Japan

[21] Appl. No.: 715,058

[22] Filed: Aug. 17, 1976

[30] Foreign Application Priority Data

| | | | |
|---|---|---|---|
| Aug. 20, 1975 | [JP] | Japan | 50-100766 |
| Apr. 14, 1976 | [JP] | Japan | 51-042086 |
| Apr. 15, 1976 | [JP] | Japan | 51-042765 |

[51] Int. Cl.[2] ..... C04B 31/00

[52] U.S. Cl. ..... 106/74; 106/38.3; 106/38.35; 264/82; 264/85

[58] Field of Search ..... 106/74, 38.3, 38.35; 264/82, 85

[56] References Cited

U.S. PATENT DOCUMENTS

| | | | |
|---|---|---|---|
| 2,883,723 | 4/1959 | Moore et al. | 106/74 |
| 2,905,563 | 9/1959 | Ilenda et al. | 106/38.3 |
| 2,952,553 | 9/1960 | Ilenda et al. | 106/38.35 |
| 2,997,758 | 8/1961 | Tiberg et al. | 106/38.3 |
| 3,074,802 | 1/1963 | Alexander et al. | 106/38.3 |
| 3,218,683 | 11/1965 | Nishiyama et al. | 106/38.3 |

*Primary Examiner*—L. Dewayne Rutledge
*Assistant Examiner*—John P. Sheehan
*Attorney, Agent, or Firm*—Wender, Murase & White

[57] ABSTRACT

The present invention relates to a molding process using a silicate binder substantially based upon an alkali silicate having a higher molecular ratio of silica to alkali. More particularly, it relates to improvements in a molding process, wherein the mold and core are cured by gassing with exceedingly diluted $CO_2$ and the $CO_2$ gas consumption for the curing of the molds is reduced to between about ½ - 1/20 compared with that of the conventional $CO_2$ curing process. The resulting molds and cores exhibit an excellent collapsibility after casting, develop no harmful gas in curing and casting procedures, and the used waste sands do not cause any serious soil or water pollution problems.

15 Claims, 10 Drawing Figures

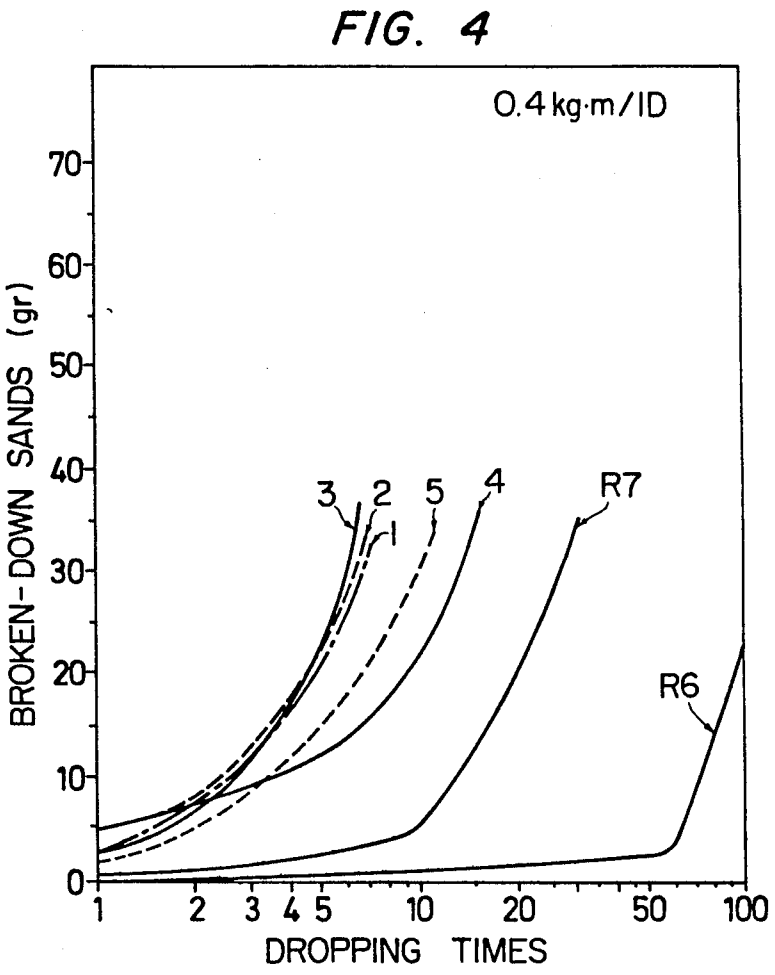
FIG. 4
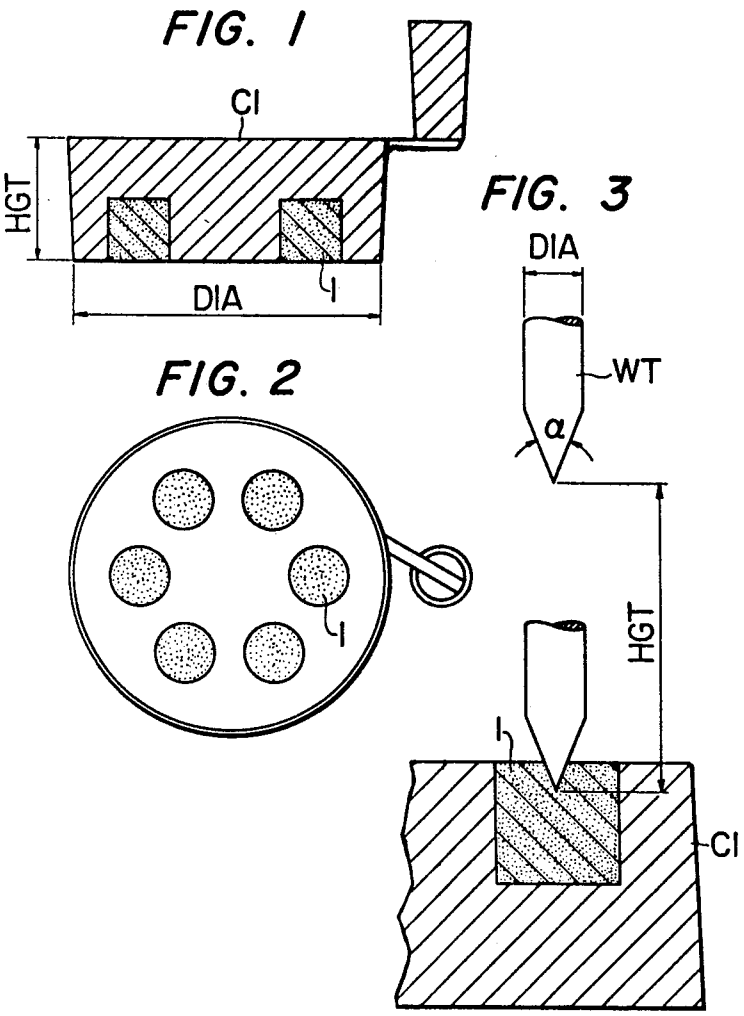
FIG. 1
FIG. 3
FIG. 2

0.4 kg·m/ID
BROKEN-DOWN SANDS (gr)
DROPPING TIMES
0
10
20
30
40
50
60
70
80
1
2
3
4
5
10
20
50
100
12
22
21
23
24
10a
25
R10
R9

0.4 kg·m/ID
BROKEN-DOWN SANDS (gr)
DROPPING TIMES
0
10
20
30
40
50
60
70
1
2
3
4
5
10
20
50
100
12
10a
7
6

COMPRESSION STRENGTH (kg/cm²)
50
40
30
20
10
0
1
24
200
400
600
800
1000
1200
1400
STORED TIME (HR)
HEATED TEMPERATURE (°C)
6
10a
12
7

COMPRESSION STRENGTH (kg/cm²)
50
40
30
20
10
0
1
24
200
400
600
800
1000
1200
1400
STORED TIME (HR)
HEATED TEMPERATURE (°C)
R6
R7
5
3
4
2
1

COMPRESSION STRENGTH (kg/cm²)
60
50
40
30
20
10
0
1
24
200
400
600
Ar800
ArS.H.
STORED TIME (HR)
HEATED TEMPERATURE (°C)
29
R11
R9
28
25
21

COMPRESSION STRENGTH (kg/cm²)
60
50
40
30
20
10
0
1
24
200
400
600
Ar800
ArS.H.
STORED TIME (HR)
HEATED TEMPERATURE (°C)
19a
17
20
16a

MOLDING METHOD

DEFINITIONS

The term "alkali silicate" denotes a water-soluble silicate consisting essentially of silica and monovalent alkali ions including sodium, potassium, lithium, and ammonium ions. The term "silicate binder" denotes a binder substantially based upon alkali silicates. The term "molecular ratio of silica to alkali" denotes the molar ratio of $SiO_2/M_2O$, wherein M denotes a monovalent alkali ion, and this term is abbreviated as "M.R.".

BACKGROUND OF THE INVENTION

It has long been known, that the $CO_2$ molding process requires sodium silicate of so-called "lower molecular ratio" as a binder, and the mold is cured by gassing with either pure or concentrated $CO_2$, the "lower molecular ratio" is understood to denote a ratio of between about 2-2.5. Since over 25 years it has been believed that silicates having a higher molecular ratio are not suitable as a $CO_2$ process binder because they can not provide sufficient bonding strength to the mold. Thus the silicate having M.R. 2.7 has rarely been used as a $CO_2$ process binder.

Although the conventional $CO_2$ cured mold which is bonded with lower M.R. silicates shows a high bonding strength, it has several essential disadvantages: — Firstly, it has a very poor collapsibility after casting. Secondly, it requires a large consumption of curing $CO_2$, e.g., as much as the same amount by weight as that of the binder by weight. Consequently, the cost of $CO_2$ for the molds amounts to about 2-2.5 times that of the binder. Furthermore, the used sands from the conventional $CO_2$ process molds can not be reused beneficially and most of the used sands have to be discarded as waste, which inevitably causes undesirable soil and water pollution problems due to the higher alkali content and the higher water solubility of the lower M.R. silicate binder in the used sands. Since the $CO_2$ process had come into wide use, these disadvantages caused the $CO_2$ process to be replaced by other molding processes using, e.g., organic binders.

Much effort has since been expended to overcome the poor collapsibility of $CO_2$ process molds by admixing different kinds of break-down agents. Nevertheless there is much to be desired in admixing break-down agents because a large amount of such additives usually provides a poor surface stability and a lower strength to the molds. Furthermore, organic or carbonaceous break-down agents do not work at temperatures higher than 1000° C., to which the molds for iron and steel casting are subjected. It has been proposed to dilute the $CO_2$ with air in the conventional $CO_2$ process in order to reduce the $CO_2$ consumption, but it has been proved that the $CO_2$ consumption can be reduced no more than 30% by this method compared with pure $CO_2$ curing, when the lower M.R. silicate binder is employed as described in Table 4 of the detailed description, this is supported by the following report: K. Hara et al.: "Application of $CO_2$-Air mixing Gas to $CO_2$ Process" The Journal of the Japan Foundrymen's Society, No. 4, Vol. 39, p. 64, 1967.

On the other hand, it has been suggested that a better collapsibility would be achieved by using a sodium silicate binder having a relative high M.R. of about 3. But there were no effective curing methods available in practice expect for the following two methods: —

Firstly, heating the mold up to 250°-300° C. for a period of more than half an hour, which leads to a very low productivity and is uneconomical. Secondly, curing with dried or hot air, which can not uniformly cure the whole body of a large mold in practice because the moisture-saturated air will form water-saturated layers next to the dried layer. Furthermore, it takes at least 10 minutes to cure the test mold piece completely and the injection of dried air blows off the sand particles around the blowing hole. Thus the dried air injection can not be employed in practice.

According to the conventional $CO_2$ process, such a mold which was bonded with higher M.R. silicate binder could not be cured properly in the usual working process on account of the following reasons: — A mold bonded with sodium silicate having a M.R. of e.g. 3.16, can be cured rapidly by the conventional gassing method, but the bonding strength will so rapidly be lost in the short lapse of time after curing, that one day after gassing the mold will turn practically useless for casting, the silicates having a much higher M.R. than 3.16, as shown in Table 1 below are even more useless in comparison with the present invention. Thus the sodium silicate having a M.R. of not less than 2.7 could not be used beneficially as a molding binder for the conventional $CO_2$ process. The other alkali silicates could not be used due to the same phenomena.

Contrary to the above described prior art, it has now been found why such a rapid deterioration of the bonding strength of a once cured mold which is bonded with a higher M.R. silicate occurs. The rapid deterioration of the bonding force is based essentially on the hypersensitivity of the higher M.R. silicates toward $CO_2$. It has further been found based on the above, that the mechanism of developing a strong bonding strength with a higher M.R. silicate does not depend on the shocking and complete gelation, especially not on being shocked to gelation by concentrated $CO_2$ injection. If the silicate film coating of the sand particles is shocked to gelation by gassing with $CO_2$ according to the prior art, the silicate film loses it's bonding strength quite rapidly after being cured. The lower M.R. silicate binder is not so sensitive as the higher M.R. silicate, therefore the concentrated $CO_2$ injection can provide a strong bonding force except when too much $CO_2$ is injected, e.g., the mold is overgassed.

Further according to the above there is provided a proper method to overcome the aforementioned problem in the prior art, i.e., wherein a dilution agent for the $CO_2$ is introduced to the gas in such an amount that the agent may inhibit the reaction between the higher M.R. silicate binder and $CO_2$. By diluting the $CO_2$ exceedingly with the inhibiting agent to a $CO_2$ concentration of not more than 20%, the mold sands which are admixed with the higher M.R. silicate can be cured properly. Furthermore, the $CO_2$ consumption for curing the mold is reduced to about 1/20-½ compared with that in the prior art process.

Furthermore, many other disadvantages due to the lower M.R. silicate binder, e.g., soil or water pollution problems caused from the high alkalinity of the used waste sands and difficulties in the recovery of the sand can be either eliminated or reduced by the application of a higher M.R. silicate binder.

OBJECTS OF THE PRESENT INVENTION

Accordingly, the first object of the present invention is to provide a molding process wherein the curing $CO_2$ consumption is much less than that in the prior art processes.

The second object of the present invention is to provide a molding process wherein the resulting molds exhibit excellent collapsibility.

The third object of the present invention is to provide a molding process wherein the used sands do not cause serious soil and water pollution problems.

The fourth object of the present invention is to provide a mold developing no harmful gases in curing and casting procedures.

The fifth object of the present invention is to provide a mold the used sands of which can be re-used beneficially.

The seventh object of the present invention is to provide a molding process wherein the mold is cured in a very short time and can be drawn off from the pattern immediately after curing.

In general, the object of the present invention is to provide a molding process and a mold which is excellent from all points of view, i.e., having minimum $CO_2$ consumption, having an excellent collapsibility, causing no serious soil-, water- and atmospheric pollution problems, and providing a possibility of reusing the used sands as well as rapid curing.

SUMMARY OF THE INVENTION

The present invention relates more particularly to improvements in a molding process wherein a sand mixture admixed with a silicate binder having higher molecular ratio of silica to alkali is properly cured by gassing with exceedingly diluted $CO_2$ in a short period of time.

The alkali silicate binder having a higher molecular ratio which essentially based upon sodium, potassium, lithium and/or ammonium silicate is mixed with sands, then the sand mixture is rammed into the mold and gassed with exceedingly diluted $CO_2$ which diluted with a gas which is inert towards alkali silicates to a $CO_2$ concentration of not more than 20 v/v %. The $CO_2$ consumption for curing in this process is reduced to an amount of between ½–1/20 compared with that in the conventional $CO_2$ process. While the resulting mold has enough green and hot strength for iron and steel casting, the mold exhibits excellent collapsibility after casting. The lower alkali content in the higher molecular ratio silicate binder provides good re-use characteristics to the sands. The silicate binder contains no detrimental substance. Thus provides the advantages that the resulting molds develop no harmful gas in both curing and casting procedures and the waste sands cause no serious soil and water pollution problems.

In particular according to the present invention there is provided a molding process which comprises the steps of (a) forming a molding composition by admixing at least one alkali silicate binder selected from the group consisting of a sodium silicate having a molecular ratio $SiO_2$ alkali metal oxide of from 2.7 to 4.5, a potassium silicate having a molecular ratio $SiO_2$ alkali metal oxide of from 2.5 to 5.0, a lithium silicate having a molecular ratio $SiO_2$ alkali metal oxide from 2.0 to 5.5 and an alkali metal-ammonium silicate having a molecular ratio $SiO_2$ alkali metal oxide from 2 to 9 to a refractory material (b) ramming the molding compositions into a mold and (c) then gassing the molding composition with a dilute $CO_2$ gas essentially consisting of $CO_2$ and a gas which is inert towards alkali silicate wherein the $CO_2$— concentration is not more than 20 v/v%. Suitably, the alkali silicate binder has a molecular ratio of 2.7–4.5 in particular of 3.0–4.5.

BRIEF DESCRIPTION OF DRAWINGS

FIG. 1 shows a cross-sectional view of a collapsibility testing cast piece (DIA): diameter at the bottom is 250 mmϕ. (1): core, (HGT): height of cast piece 100 mm.

FIG. 2 shows the bottom view of the testing piece shown in FIG. 1. (1): core.

FIG. 3 shows a flow sheet of a collapsibility testing method of cores after casting. (1): core, (WT): dropping bar weight 2kg, (HGT); height of drop 200 mm, (DIA): diameter of bar weight 25 mmϕ, (α): angle of conetop 45°.

FIG. 4, FIG. 5 and FIG. 6 show collapsibility diagrams of tested cores including comparative samples which are prepared by a conventional $CO_2$ process.

Abscissa: dropping times = number of droppings of the dropping bar weight in log scale Ordinate: weight of broken-down sands in gram Energy per 1 drop: 0.4 kg.m. The reference numerals shown at each curve coincidents with the numeral of the corresponding example of the present invention listed in one of the Tables 4, 5, 6 and 8, while the numerals with the prefix "R" refer to the comparative samples which are prepared by a conventional $CO_2$ process. In FIG. 5. collapsibility diagrams of examples containing higher M.R. alkali silicates are shown.

FIG. 6 shows the effect of higher M.R. alkali silicates as compared with that of the lower M.R. alkali silicates comparative samples (R9) and (R10). The higher M.R. alkali silicate containing example (25) including no additives shows a much better collapsibility than (R10) including sucrose. (21)–(24) contain organic inhibitors. (12) contains carbonateous material.

Abscissa: storage time of the mold after gassing in hours (HR) and heating temperature in centigrades.

Ordinate: compression strength in $kg/cm^2$

Figure 7:
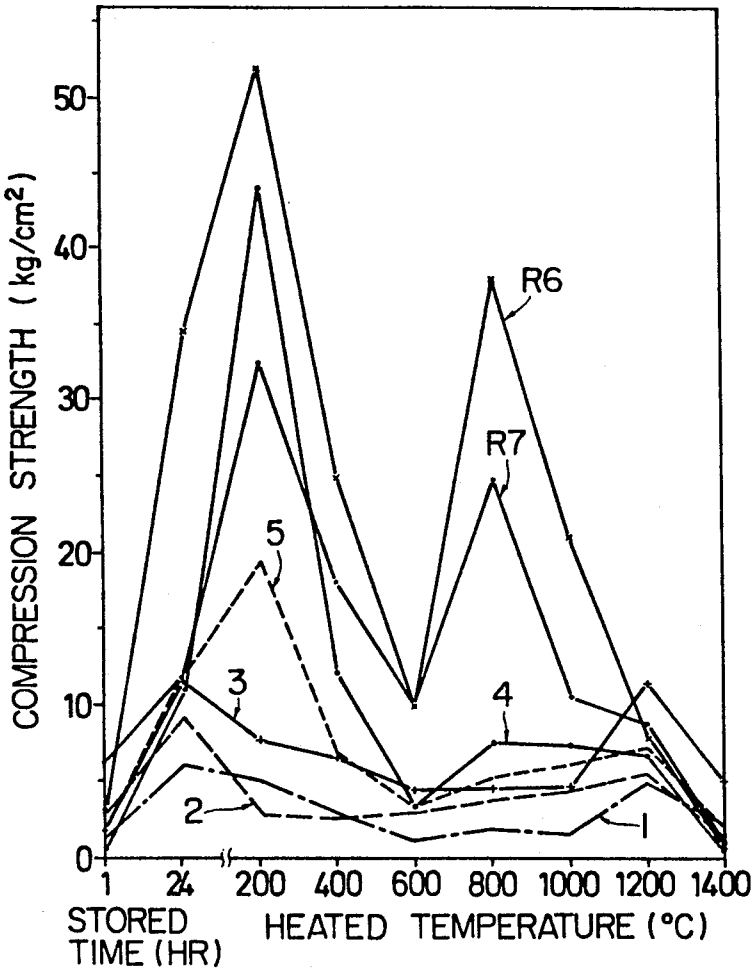

FIG. 7 corresponds to FIG. 4 using Seto-Jinya sands.

Figure 5:
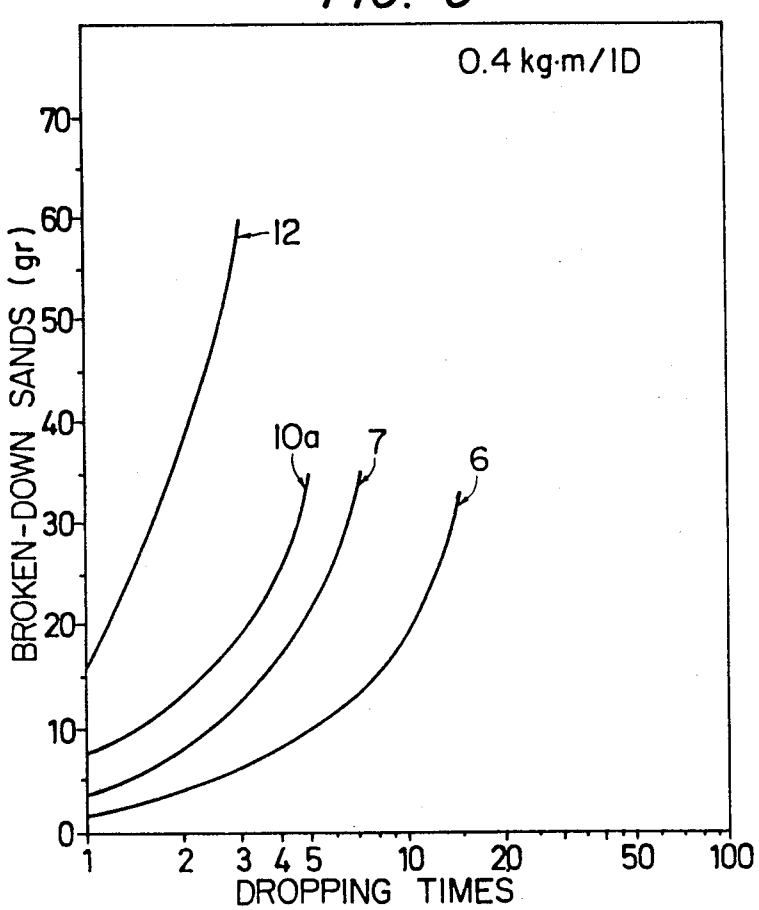
Figure 8:
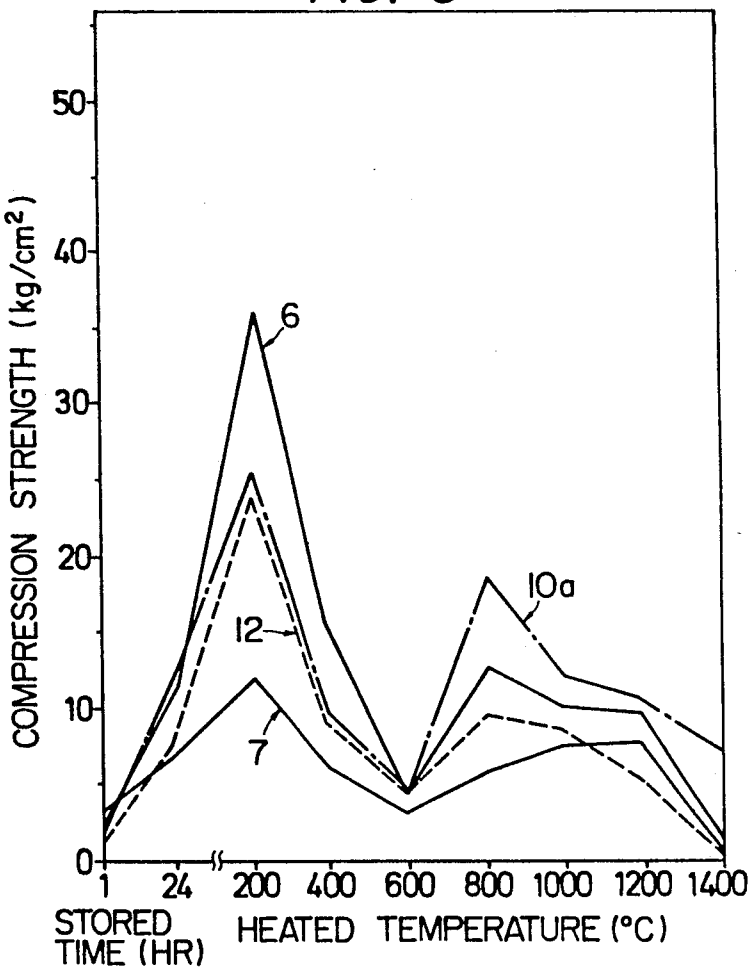
FIG. 7–FIG. 10 show diagrams of the green strength of the samples at different storage times and of the retrained strength after the samples have been subjected to high temperatures.

FIG. 8 corresponds to FIG. 5, (6) and (7): Seto-Jinya sands, example (12) contains carbonaceous material while the other examples do not contain any additives.

Figure 9:
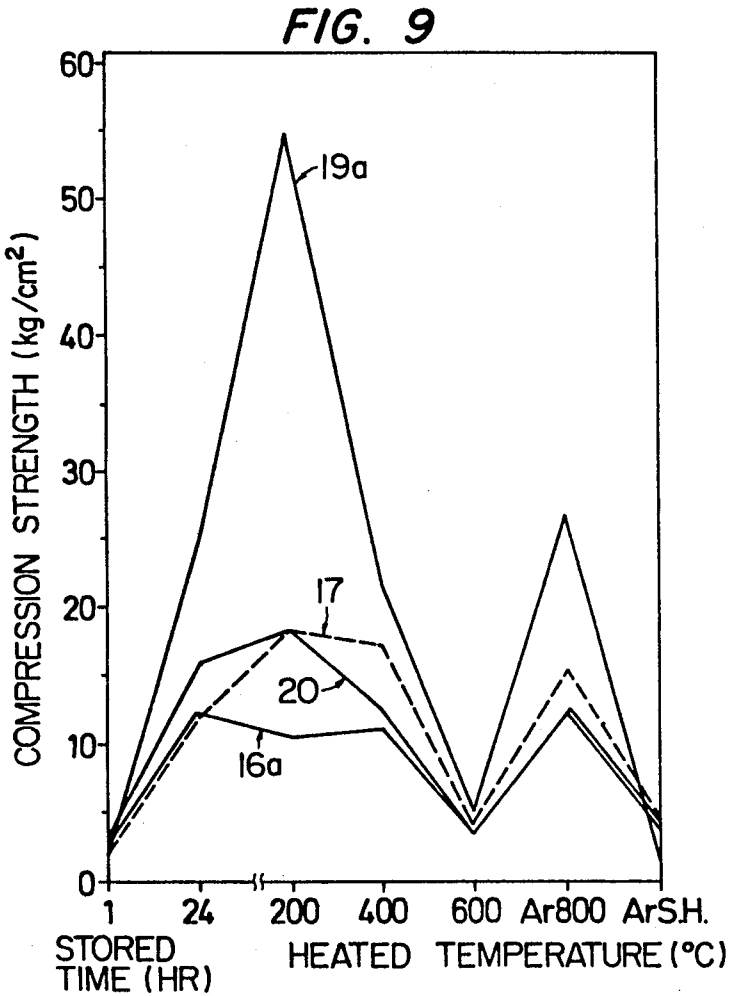

FIG. 9 shows the effect of admixing an inhibitor e.g., ammonium silicate (16*a*) and colloidal silica (17) compared with not adding any inhibitor (19*a*) to the mixture of same alkali silicate having a M.R. of 3.47 and Flattery sands. Example (20) contains an alkali silicate having a M.R. of 3.66.

Figure 10:
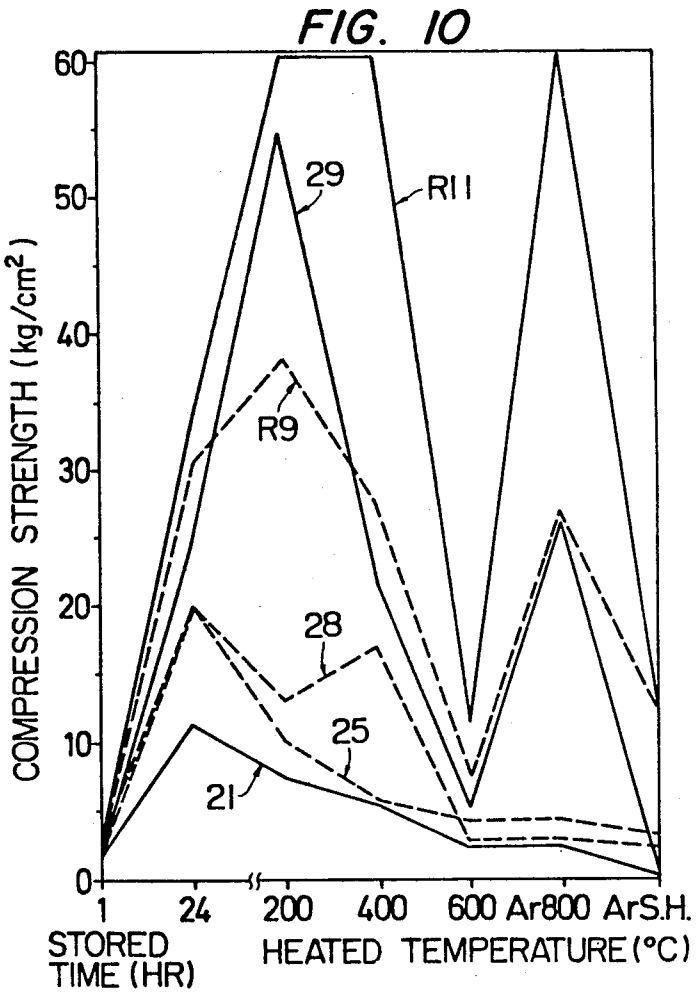

FIG. 10 shows effect of admixing organic inhibitors to higher M.R. alkali silicates (21,28) and to the conventional lower M.R. (R11) and (R9). Full lines show Flattery sands while dotted lines show Japanese Mikawa sands. (21,25,28,29) are based on the same higher M.R. alkali silicate M.R. 3.47.

DETAILED DESCRIPTION

As described above, there was no good process available for preparing a mold bonded with a higher M.R. silicate binder, although the higher M.R. silicate binder has many advantages. The dry air injection or suction requires too much time for curing the whole body of the mold, which makes this method unpractical. $CO_2$ gas dilution with air to a $CO_2$- concentration in the range of between about 50–70 v/v% of the diluted gas can not properly be employed for curing the higher M.R. silicate binder. This $CO_2$ dilution with air was only proposed to reduce $CO_2$ consumption in the prior art processes using a lower M.R. silicate binder. The maximum reduction was 30%. It has long been recognized that further dilution of the $CO_2$ to a $CO_2$-concentration of less than 50% will rather prolong the total gassing time and the $CO_2$ consumption can not be reduced any more.

In Table 1, there are listed test samples prepared by the prior art processes, i.e., curing by 100% $CO_2$ using alkali silicates having different M.R. values, e.g., 2.25 (lower): 3.16 and 4.1 (higher). (R1)–(R4c) show that the conventional $CO_2$ injection can not give a strong bonding force to the higher M.R. silicate binder. Testing pieces are made according to JIS Z-2603 and dimensioned to 50 mmϕ × 50 mm height. "S.S.I" denotes the Surface Stability Index which represents the remaining weight of the tests piece after it has been shaken for 1 minute on the 6-meshes-sieve in % by weight of the initial weight. (R6) and (R7*a,b*) show the conventional $CO_2$ mold, wherein the $CO_2$ ratio amounts to more than 220% during a gassing time of 10 seconds. A lower gassing pressure and a shorter gassing time than those which are listed in the tests are not enough and suitable in the practice of large mold-curing.

All test samples which are prepared by the prior art processes are prefixed with "R". Employed sands are listed in Table 2, and employed silicate binders including those in the comparative samples are listed in Table 3.

The reaction between the alkali silicate and $CO_2$ proceeds according to the following formula: $M_2O \cdot nSiO_2 + CO_2 \rightarrow M_2CO_3 + nSiO_2$ wherein $n$ represents the molecular ratio of silica to alkali abbreviated as M.R., M denotes a monovalent alkali ion and consists essentially of a monovalent alkali metal ion and/or ammonium ion. (The ammonium silicate has rather different properties and will be described afterwards). The present invention is based essentially upon the recognition of the fact that the character "$n$", i.e., the M.R. determines the reactivity of the silicate towards $CO_2$. As shown by (R1) in Table 1, the bonding force of the higher M.R. silicate is completely lost one day after gassing, which fact has proved that the shocking gelation by concentrated $CO_2$ provides no bonding force to the higher M.R. silicate binder. Subsequent experiments testing the reactivity of higher M.R. silicate towards $CO_2$ on exposure have disclosed the following features. While the reactivity of the sodium silicate varies very slowly between silicates having a M.R. of about 2–2.5, it increases with a progressively increasing degree when the M.R. is increased by more than about 2.7–3.0, and finally, it reaches an ultimate hypersensitive state. For example, a sodium silicate having a M.R. of 4.5 exhibits very labile features.

Based on the above it has been further recognized that: The chemical bonding of a higher M.R. silicate binder cured with $CO_2$ provides a proper bonding force only when the silicate film is gelled properly under mild conditions, i.e., is reacted with $CO_2$ only in a mild procedure. In the case that the silicate will be shocked to gelation, the binder will lose it's bonding force quite rapidly after gassing. Such a phenomenon is obviously not observed in the conventional $CO_2$ process because the reactivity of the lower M.R. silicate is very dull in comparison with that of the higher M.R. silicate. The higher M.R. silicate is directly subjected to such a shocking gelation due to it's high reactivity to $CO_2$ although $CO_2$ is a weak acid for itself.

In order to avoid such a shocking gelation, there is provided a process for inhibiting the reaction between the silicate and $CO_2$. Such purpose may be achieved by two methods. Firstly, the $CO_2$ gas is mixed with a gaseous inhibitor, i.e., is diluted with a gas which is inert towards alkali silicate. Secondly, the silicate binder may be admixed with an aqueous or solid reaction inhibitor.

The first method consists of diluting the $CO_2$ with a gas which is inert towards alkali silicate to a $CO_2$-concentration of not more than 20 v/v% of the diluted gas mixture. The gaseous diluting agent consists essentially of air, oxygen, nitrogen, hydrogen, and/or an inert gas such as helium, argon etc., preferably compressed air.

The compressed air may be dried or heated, which however is not indispensable, but heating the air to temperatures higher than 100° C. is not desirable because of the reasons which are mentioned above in the "BACKGROUND". For example in an embodiment of the present invention, the compressed air having an atmospheric relative humidity of about 50–95% is employed.

The concentration of $CO_2$ ranges from more than atmospheric $CO_2$ concentration to not more than 20%. A proper concentration range of $CO_2$ depends upon the M.R. of the silicate and the type of the alkali silicate. Potassium silicate is more sensitive than sodium silicate, and the lithium silicate having the same M.R. is even more sensitive. Therefore the employable lowest M.R. in the present invention for potassium and lithium silicate is lower than that of sodium silicate, i.e., about 2.5 and 2.0 for potassium and lithium silicate respectively. The maximum limit of the M.R. of potassium and lithium silicate is about 5.0 and 5.5, respectively.

Besides the $CO_2$ dilution which is an essential method to inhibit said reaction, there are additional auxiliary ways consisting of admixing an inhibiting agent to the silicate binder or sand mixture. Among numerous materials, some inorganic or organic materials are suitable for this purpose, i.e.: Colloidal silica is inert towards $CO_2$ and alkali-stabilized colloidal silica may be admixed with the alkali silicate without causing gelation provided the mixing is carried out with care since the mixture remains stable for only a short period of time. The admixed colloidal silica exhibits an inhibiting effect on the reaction with $CO_2$ and furthermore, plays the role of a break-down agent due to the silica content, which influences the break-down properties in such a way as if the M.R. of the used silicate had been further increased. The term "alkali-stabilized" is understood to mean "stabilized in an alkaline pH range". The ratio of the alkali silicate to said colloidal silica is 100:0.1–1:2, preferably 100:1–5:1 on the base of silica.

Ammonium silicate, e.g., quaternary ammonium silicate, exhibits a good inhibiting effect and can be admixed to the alkali silicate in any proportion to give a stable mixture. Ammonium silicate is fairly inactive in comparison with alkali metal silicate having higher M.R. and reacts very slowly or slightly with $CO_2$ at the concentration which it employed for curing said higher M.R. alkali silicate binder. Accordingly, it exhibits good inhibiting properties. A good break-down is also achieved at relatively low temperatures of between 200°–400° C. as well as at higher temperatures. Furthermore the strength of the mold in the heat is enhanced by admixing ammonium silicate. This is very important for the mold. The ratio of the alkali metal silicate to said ammonium silicate is 100:0.1-1:10, preferably 100:1-1:3 on the base of silica.

An alkali metal-ammonium silicate exhibits equally good properties as the alkali metal silicate admixed with ammonium silicate. Quaternary ammonium silicate is a composition consisting of silica and a quaternary ammonium base represented by the following formula:

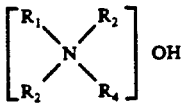

wherein each of $R_1$, $R_2$ and $R_3$ denotes alkyl or hydroxyalkyl having 1-20 carbon atoms and $R_4$ denotes alkyl having 1-4 carbon atoms. The alkali metal-ammonium silicate comprises the above quaternary ammonium base. The ratio of silica to alkalimetal oxide in the alkali metal-ammonium silicate is 2:1-9:1 on the base of silica. The above colloidal silica and ammonium silicate can be both admixed with the silicate binder. "Alkali metal" comprises sodium, potassium and lithium. Examples using colloidal silica or ammonium silicate are listed in Table 7. The molecular ratio of the ammonium silicate ($SiO_2/M_2O$, that is $SiO_2$/ammonium base anhydride) suitably is from about 1/2-7.

Besides the materials based essentially on silica, some organic materials can inhibit said reaction and also function as a break-down agent. Such materials are saccharides, polysaccharides, and polyhydric alcohols. Saccharides comprise glucose, fructose, mannose and invert sugar which is a mixture of monosaccharides. Polysaccharide means a di-, tri- or other polysaccharide including sucrose, dexistrin, starch and soluble starch. Polyhydric alcohol means an alcohol having not less than 2 hydroxyl groups and includes mannitol, sorbitol, glycerin and glycol. Sucrose, sorbitol and mannitol are employed in examples of the present invention. The above materials are essentially water-soluble and non-reactive against silicate and $CO_2$. Furthermore, they do not seriously deteriorate the bonding force of the silicate binder. While most of the above organic materials have long been known as break-down agents in the conventional $CO_2$ process, there is much left to be desired in the break-down property, provided the lower M.R. silicate is employed. In combination with a saccharide, a polysaccharide or a polyhydric alcohol, suitably an alkali silicate having a molecular ratio of 3-4.5, particularly a sodium silicate having a molecular ratio of 3.3-4.5 is used.

In the present invention, the above organic materials exhibit firstly inhibitor, and secondly break-down agent properties. In the case that the used sands are recovered, it is preferable to employ the above organic materials because these materials provide a longer moldable life to the sand mixture by inhibiting reactions of the binder with many reactive substances in the used sands. The above organic materials can be admixed in amounts of 0.1-30 w/w% preferably 1-20 w/w% of the silicate binder. Examples using organic inhibitors are listed in Table 8.

As for soil or water pollution problems, it is preferable to employ a silicate having M.R. higher than 3.4. When the used sands according to the present invention are dispersed in water, the dispersion shows a pH value less than 9, 20 days after being once neutralized by aluminum sulfate, while dispersions of the used sands bonded with the lower M.R. silicate binder show a pH value of 10-12 after several neutralizations. The total amount of dissolved $Na_2O$ in the cold water from sands according to the present invention amounts 27 w/w% of the total amount of $Na_2O$ in the used sands.

The recovery of the sand can be carried out efficiently in the present invention, because the binder includes less alkaline substance. Preferably, the above-mentioned inhibitors are employed so that the total alkali content in the sands may be reduced. The used sands contain more alkali than the new but the collapsibility will be damaged only a little because the collapsibility depends on the M.R. of the silicate.

The present invention can be applied to all kinds of molds and cores, e.g., having a weight of from 10g-10t for casting of nonferrous or ferrous material, preferably to molds and cores which require a quick curing. The initial compression strength of just cured molds ranges from 1 to 4 Kg/cm$^2$, which strength is enough to draw off the cured mold from the pattern. The compression strength reaches its maximum in one day after gassing.

EXAMPLES

Figure 6:
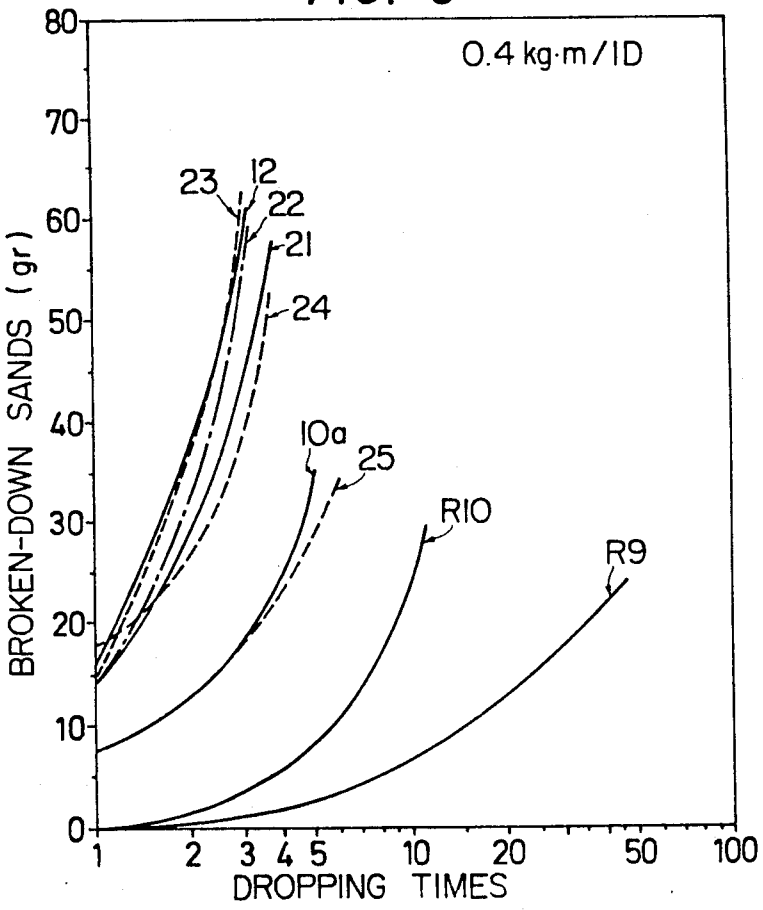

The following examples are listed as preferred embodiments of the present invention but do not consititute a limitation thereof. These examples are listed in Tables 4-8 and shown in FIGS. 1-10. Table 2-3 show the sands and binders employed in the tests. The comparative samples which are prepared by the prior art process are marked in Table I and in the above Tables and Figures by the prefix "R". Testing molds and cores are prepared as described above and cured by gassing with dilute $CO_2$. The $CO_2$ concentration, gassing time, $CO_2$ consumption in $CO_2$ ratio, compression strength and retained compression strength, and Surface Stability Index are measured and described. The collapsibility is tested as follows: The testing cast piece (FC 30,32kg) shown in FIG. 1 and FIG. 2 is casted at 1,400° C. The collapsibility of the core is determined as the weight of broken-down sands as is shown in FIG. 3, by dropping the bar-weight from the height of 200 mm above each sand level. The resulting data are shown in FIG. 4-FIG. 6.

FIGS. 7-10 show the green strength at different storage times (or bench time) after gassing and the retained strength of the molds including comparative samples. (However, it has been proved that the retained strength at temperatures higher than 1000° C. does not represent the collapsibility in the conventional $CO_2$ molds.)

Table 4 shows fundamental examples of the present invention and comparative samples. FIG. 4 corresponds to Table 4.

Table 5 shows the various upper or lower values of the $CO_2$ concentration and the M.R. of sodium silicate in the present invention. Here is shown the $CO_2$ consumption of large molds as $CO_2$ ratio, wherein $CO_2$ ratio for the molds of weight 2Kg is representative of much larger molds. Compared with (R8) according to the prior art the $CO_2$ consumption according to the present invention is reduced to about ½ (example 14)-1/20 (example 11 or 13).

Table 6 shows comparative samples using Mikawa (R9, 10) and Flattery (R11) sands, wherein the latter exhibits a quite high retained strength. (R10) is a comparative sample containing sucrose which is prepared by the conventional $CO_2$ process and which demonstrates a relative low strength (11.1 Kg/cm$^2$) and a lower collapsibility than the examples of the present invention including no break-down agent. The above can be seen more clearly in FIG. 6.

Table 7 shows a lithium silicate binder containing example (15), examples containing ammonium silicate (16a, 16b) and colloidal silica (17,18) using Flattery sands. In examples (16a, 16b) a quaternary ammonium silicate (methyl triethanol ammonium silicate, $SiO_2$ 30%) is employed. As is well known, the green and retained strength depend upon the sands (silica purity, particle form, grain size distribution etc.). While Seto-Jinya sands (Table 4, FIG. 7) provide a lower strength, Mikawa sands provide a higher strength and Flattery sands an even higher strength. FIG. 7 and FIG. 8 are shown to provide a better understanding of the listed data in Tables 1–8. The mold-heating under argon flow simulates the heat hysteresis of a usual mold for ferrous casting. The data corresponds relatively well to the collapsibility data shown in FIGS. 4–6.

Table 8 shows the examples containing organic inhibitors. In FIG. 6, (21–24) correspond to the above equally numbered examples. (25) includes no additive. All examples listed in Table 8 exhibit excellent collapsibility in comparison with the comparative examples (R6–R10).

Example (12) in FIG. 5 and in Tables 5, 6 shows the effect of admixing carbonaceous material as a break-down agent to the higher M.R. silicate. A wide variety of known additives may be employed in the scope of the present invention if a much better collapsibility is desired.

In general, the present invention provides a new molding process, wherein molds are bonded with a higher M.R. silicate binder by curing with exceedingly diluted $CO_2$ and at highly reduced $CO_2$ consumption. Furthermore, the resulting molds exhibit excellent collapsibility, develop no harmful gas and contain no detrimental substance in the used sands, and the used sands can be efficiently re-used, due to their low alkalinity. In the scope of the present invention, a wide variety of embodiments may be done without departing from the gist of the present invention. The dilute $CO_2$ used according to the invention may be heated to a temperature of not more than about 100° C.

TABLE 1 (1)

| Reference No. | Binder M.R. | Binder (2) w/w% | Curing* $Co_2$ pressure** kg/cm² | Curing* gassing time sec. | $CO_2$ ratio w/w % | Compression strength kg/cm² stored time Hrs 1 | 2 | 24 | S.S.I.*** w/w % | Remarks |
|---|---|---|---|---|---|---|---|---|---|---|
| R1 | 4.1 | 5.5 | 0.8 | 7 | 168 | 6.1 | 6.1 | 0 | 0 | |
| R2a | 3.16 | 5.5 | 0.8 | 15 | 366 | 5.5 | 7.1 | 3.6 | 80.2 | |
| R2b | 3.16 | 5.5 | 0.8 | 30 | 712 | 6.45 | — | 2.6 | 78.3 | |
| R3a | 3.16 | 5.5 | 0.8 | 15 | 338 | 6.3 | 3.8 | 1.3 | 62.1 | |
| R3b | 3.16 | 5.5 | 0.8 | 30 | 726 | 4.9 | — | 0.7 | 14.4 | rammed at 30 min. after mulling |
| R4a | 3.16 | 6.0 | 0.55 | 2.5 | 40 | 3.15 | — | 2.35 | 90 | Potassium silicate |
| R4b | 3.16 | 6.0 | 0.55 | 5 | 93 | 3.4 | — | 3.6 | 91 | Potassium silicate |
| R4c | 3.16 | 6.0 | 0.55 | 10 | 134 | 4.3 | — | 4.3 | 88.4 | Potassium silicate |
| R6 | 2.25 | 6.0 | 0.8 | 10 | 221 | 2.95 | — | 34.5 | 99.8 | |
| R7 | 2.25 | 5.09 | 0.8 | 10 | 236 | 6.4 | — | 11.8 | 99.4 | |
| R7b | 2.25 | 5.09 | | 0.8 | 15 | 385 | 6.8 | — | 9.7 | 99.5 |

*$CO_2$ concentration :100%
**gauge pressure
***S.S.I. : Surface Stability Index
(1) Seto-Jinya sands (Japanese)
(2) % by weight on the base of sands Table 2

| Sands | Chemical ingredient $SiO_2$ W/W % | Grain size distribution of sands w/w % on the sieve Meshes 28 | 42 | 60 | 80 | 100 | 200 | <200 |
|---|---|---|---|---|---|---|---|---|
| S | 98.1 | 2.7 | 54.0 | 26.3 | 10.6 | 3.0 | 3.2 | 0.2 |
| MK | 97.2 | 12.3 | 24.0 | 24.9 | 30.4 | 5.0 | 2.9 | 0.5 |
| F | 99.8 | 0.2 | 14.9 | 36.2 | 37.6 | 8.6 | 2.2 | 0 |

NOTES;
S: Seto-Jinya sands, Japanese
MK: Mikawa sands, Japanese
F: Flattery sands, Australian Table 3

| Ex. No. | Reference No. | M.R. | Concentration Be degrees* | $Na_2O$ w/w% | $K_2O$ w/w% | $SiO_2$ w/w% |
|---|---|---|---|---|---|---|
| 1 | R1 | 4.1 | 30 | 5.51 | — | 21.89 |
| 2 | — | 3.75 | 32.6 | 6.32 | — | 22.99 |
| 3 | — | 3.47 | 36 | 7.39 | — | 24.87 |
| 4, 5 | R2, R3 | 3.16 | 42 | 9.33 | — | 28.46 |
| — | R5 | 2.25 | 35 | 9.20 | — | 20.10 |
| — | R6, R7 | 2.25 | 50 | 13.80 | — | 30.10 |
| 6 | R4 | 3.16 | 30 | — | 9.50 | 19.12 |
| 7** | — | 3.75 | 32.6 | 4.41 | 2.76 | 23.16 |

NOTES;
*Baume degrees at 20° C
**Na-K-Silicate

TABLE 4(1)

| Example No. | Binder M.R. | Binder %* | Curing $CO_2$%** | Curing Gassing time sec | $CO_2$ ratio %*** | Compression strength kg/cm² stored time 1 | 24 hrs | Surface stability index % (S.S.I.) | Remarks |
|---|---|---|---|---|---|---|---|---|---|
| 1 | 4.1 | 7.14 | 2.68 | 12 | 7.5 | 1.3 | 6 | 98.9 | |
| 1b | " | " | " | 18 | 11.5 | 1.8 | 5.5 | 98.2 | |
| 2 | 3.75 | 6.33 | " | 12 | 8.2 | 1.5 | 9.6 | 98.7 | added water 0.2% on the base of sands |
| 2b | " | " | " | 30 | 20.5 | 2.8 | 9.1 | 97.6 | |
| 3 | 3.47 | 5.8 | " | 15 | 9.8 | 1.2 | 11.5 | 99.3 | water 0.5% |
| 3b | " | " | " | 30 | 21.0 | 2.2 | 9.8 | 99.1 | " |
| 4 | 3.16 | 6.43 | 5.0 | 10 | 12.1 | 0.6 | 11 | 98.4 | |
| 4b | " | " | " | 15 | 18.3 | 1.2 | 11.1 | 98.7 | |
| 5 | " | 5.36 | 10.2 | 7.5 | 23 | 2 | 11.5 | 98.3 | water 0.54% |
| 5b | " | " | " | 15 | 45 | 2.7 | 8.0 | 98.5 | " |
| 6 | " | 6 | 5.24 | 15 | 21.4 | 2.2 | 11.4 | 99.4 | Potassium silicate |
| 6b | " | " | " | 30 | 42.4 | 4.5 | 9.7 | 99.6 | " |
| 7 | 3.75 | 6 | 2.68 | 12 | 9.0 | 2.75 | 6.9 | 99 | Na-K-silicate |

TABLE 4[1]-*continued*

| Example No. | Binder M.R. | Binder %* | Curing $CO_2$%** | Curing Gassing time sec | $CO_2$ ratio %*** | Compression strength kg/cm² stored time 1 | Compression strength kg/cm² stored time 24 hrs | Surface stability index % (S.S.I.) | Remarks |
|---|---|---|---|---|---|---|---|---|---|
| 7b | " | " | " | 18 | 13 | 2.14 | 5.4 | 97.9 | " |
| R5a | 2.25 | 5.5 | 16.7 | 15 | 68.1 | 0.3 | 4.7 | 98 | |
| R5b | " | " | " | 22.5 | 103.3 | 0.9 | 4.4 | 97.3 | |

*: % by weight on the base of sands
**: % by volume and the base of dilute gas
***: $CO_2$% by weight on the base of sands of mold
[1]Seto-Jinya sands

TABLE 5*

| Ex. No. | Binder M.R. $SiO_2/M_2O$ | Binder % | $CO_2$ v/v % | Curing method Gassing time sec. | Curing method pressure kg/cm² | temperature °C | $CO_2$ ratio w/w % | Compression strength kg/cm² stored time 1 | Compression strength kg/cm² stored time 24 hrs | S.S.I. % | Mold (core) Weight kg |
|---|---|---|---|---|---|---|---|---|---|---|---|
| 8 | 4.34[1] | 7.5 | 0.17 | 30 | 1.2 | 30 | 0.8 | 0.8 | 14.5 | 99.8 | 0.15 |
| 9 | " | " | 0.67 | " | " | " | 2.5 | 1.2 | 12.4 | 98.8 | " |
| 10a | 4.1 | 7.14 | 0.25 | 40 | 3.0 | 24 | 8.5 | 1.0 | 12.9 | 99.4 | " |
| 11 | " | " | 0.65 | 60 | " | 50 | 4.0 | — | — | — | 2.0[2] |
| 12 | " | 7.0 | 1.2 | 30 | " | 40 | 18.3 | 1.0 | 7.8 | 99.4 | 0.15[3] |
| 13 | 3.47 | 6.0 | 1.25 | 60 | " | 20 | 3.5 | — | — | — | 2.0 |
| 14 | 2.7[4] | 5.5 | 20 | 20 | " | " | 35.7 | — | — | — | " |
| R8 | 2.25 | " | 100 | " | " | " | 81.4 | — | — | — | " |

NOTES:
[1]28.5° Be at 20° C
[2]mold 100# × 170#
[3]added carbonacious material 0.2%
[4]45° Be at 20° C
*Flattery sands

TABLE 6

| Sample No. | Binder M.R. | Binder Additives w/w %[1] | Binder Additives w/w %[2] | $CO_2$ vl v % | Compression str. Kg/cm² stored time 1 | Compression str. Kg/cm² stored time 24 HR | S.S.I. % | Retained comp. str. Kg/cm² heated temp. °C 200 | 400 | 600 | Ar 800[3] | ArS.H.[4] | Sands | Broken-down sands gr/drop | $Na_2O$ sands |
|---|---|---|---|---|---|---|---|---|---|---|---|---|---|---|---|
| 9 | 4.34 | — | 7.5 | 0.67 | 1.2 | 12.4 | 98.8 | — | — | — | — | 8.2 | F[5] | 7.0 | 0.382 |
| 10b | 4.1 | — | 7.14 | 2.5 | 1.5 | 10.9 | 99.4 | 7.8 | 9.1 | 6.0 | 18.7 | 7.1 | F | 7.0 | 0.393 |
| 12 | " | — | 7.0 | 1.2 | 1.0 | 7.8 | 99.4 | 24.7 | 9.0 | 4.2 | 9.5 | 0.8 | F[6] | 19.5 | 0.386 |
| R9 | 2.25 | — | 6.0 | 100 | 3.4 | 20.3 | 99.7 | 38.1 | 27.3 | 7.2 | 26.8 | 12.6 | MK[7] | 0.6 | 0.828 |
| R10 | " | C20[8] | " | 100 | 4.4 | 11.1 | 99.9 | 14.7 | 12.5 | 3.3 | 9.4 | 8.7 | MK | 2.5 | 0.690 |
| R11 | " — | 4 | " | 3.5 | 33.1 | 99.8 | >60 | >60 | 10.8 | >60 | 13.0 | F | 0.6 | 0.552 | |

[1]% by weight on the base of alkali silicate
[2]% binder including additives
[3]Ar: heated under Ar gas flow
[4]S.H. :simulation heating according to the real heat hysteresis
[5]F: Flattery sands(Australia)
[6]added carbonations material 0.2% on the base of sands
[7]MK: Mikawa sands(Japan)
[8]C: sucrose

TABLE 7

(Flattery Sands)

| Ex. No. | Alkali | Binder Inhibitor M.R. | Binder Inhibitor w/w %[1] | Binder Inhibitor w/w %[2] | $CO_2$ v/v %[3] | Compression strength kg/cm² stored time 1 | Compression strength kg/cm² stored time 24 hrs | S.S.I. % | Retained compression strength kg/cm² heated temperature °C 200 | 400 | Ar800[4] | Ar S.H.[5] | $M_2O$ sands w/w % |
|---|---|---|---|---|---|---|---|---|---|---|---|---|---|
| 15 | Li | 3.80 | — | 7 | 0.12 | 1.3 | 6.1 | 98.1 | 1.7 | 1.3 | 0.5 | <0.3 | 0.211 |
| 16a | Na | 3.47 | Am20[6] | 4 | 1.4 | 2.5 | 12.3 | 99.6 | 10.4 | 11.0 | 12.3 | 3.9 | 0.246 |
| 16b | " | " | " | 5 | " | 2.7 | 15.4 | 100 | 13.6 | 13.5 | 19.1 | 5.7 | 0.308 |
| 17 | " | " | S10[7] | 4 | " | 1.5 | 11.9 | 99.5 | 18.3 | 17.1 | 15.3 | 4.8 | 0.269 |
| 18 | " | " | S10[8] | " | " | 1.3 | 6.6 | 99.4 | 4.3 | 4.5 | 4.7 | <1 | 0.246 |
| 19a | " | " | — | " | 3.4 | 1.8 | 24.1 | 99.8 | >50 | 21.4 | 26.8 | <1 | 0.296 |
| 19b | " | " | — | 3 | " | 2.5 | 19.3 | 99.2 | 46 | 22.2 | 15.6 | 3.8 | 0.222 |
| 20 | " | 3.66 | — | 4 | 3.5 | 2.9 | 15.6 | 99.6 | 18.3 | 12.1 | 12.6 | 4.3[9] | 0.272 |

[1]% by weight on the base of silicate
[2]% binder including admixed inhibitor on the base of sands
[3]% by volume on the base of dilute gas
[4]Ar: under Ar gas flow
[5]S.H. : simulation heating according to the real heat hysteresis of mold
[6]Am: Ammonium Silicate
[7]S: Colloidal silica
[8]Added sucrose 10w/w % on the base of silicate
[9]Broken-down sands: 8.3gr/drop

TABLE 8

| Ex. No. | Binder M.R. | Inhibitor w/w %[1] | Inhibitor w/w %[2] | $CO_2$ v/v %[3] | Compression str. Kg/cm² stored time 1 | 24 HR | S.S.I. % | Retained comp. str. Kg/cm² heated temp. °C 200 | 400 | 600 | Ar 800[4] | ArS.H.[5] | down sands Sands | Broken-Sands w/w gr/D | $M_2O$ % |
|---|---|---|---|---|---|---|---|---|---|---|---|---|---|---|---|
| 21 | 3.47 | B14[8] | 4 | 3.5 | 1.7 | 11.3 | 99.8 | 7.4 | 5.3 | 2.3 | 2.4 | <1 | F[6] | 15.0 | .246 |
| 22 | " | C20[9] | 4 | " | 2.5 | 11.0 | 99.6 | 10.8 | 4.8 | 2.8 | 2.0 | <1 | F | 18.3 | " |
| 23 | " | M20[10] | 4 | " | 2.7 | 10.9 | 99.5 | 9.3 | 4.5 | 2.1 | 1.8 | <1 | F | 20.8 | " |
| 24 | " | C6 | 6 | " | 2.1 | 12.4 | 99.4 | 6.5 | 9.8 | 2.1 | 2.8 | 1.7 | MK[7] | 13.3** | .418 |
| 25 | " | — | 6 | " | 1.7 | 20.2 | 99.3 | 10.0 | 5.6 | 4.2 | 4.3 | 3.2 | MK | 5.7 | .443 |
| 26 | " | B14 | 6 | " | 1.5 | 7.8 | 98.6 | 5.1 | 2.9 | 2.0 | 1.9 | 1.6 | MK | 14.3 | .370 |
| 27 | " | C3 | 6 | 1.3 | 2.8 | 11.2 | 99.7 | 9.4 | 4.0 | 2.8 | 4.0 | 5.5 | * | 4.3 | .847 |
| 28 | " | C3 | 6 | 3.5 | 2.5 | 19.7 | 99.8 | 13.0 | 17.0 | 2.8 | 3.0 | 2.2 | MK | 5.7 | .430 |
| 29 | " | — | 4 | 3.4 | 1.8 | 24.1 | 99.8 | >50 | 21.4 | 4.8 | 26.8 | <1 | F | 7.8 | .296 |
| 30 | 3.66 | — | 4 | 3.5 | 2.9 | 15.6 | 99.6 | 18.3 | 12.1 | 3.2 | 12.6 | 4.3 | F | 8.3 | .272 |
| 31 | 4.0 | B3 | 5.5 | 1.5 | 1.1 | 7.5 | 99.8 | 4.2 | 4.3 | 3.1 | 6.4 | <1 | F | 11.0 | .214 |

Notes:
*used sands (1cycle)
**smaller cast peice, 100m/m ϕ × 100m/m HGT, 2.8 Kg
[1]% by weight on the base of the silicate
[2]% binder including admixed inhibitor on the base of sands
[3]% by volume on the base of dilute gas
[4]Ar: under Ar gas flow
[5]S.H.: simulation heating according to the real hysterisis of mold from 1400 to 800 ° C in 1 HR
[6]Flattery sands, Australian
[7]Mikawa sands, Japanese
[8]B: sorbitol
[9]C: sucrose
[10]M: mannitol

What I claim is:

1. In a $C_2$- molding process which comprises the steps of (a) preparing a molding composition by admixing an alkali silicate binder to a refractory material;

(b) forming the molding composition in a mold; and, (c) hardening the molding composition by applying $CO_2$ thereto, the improvement which comprises the alkali silicate binder comprising at least one alkali silicate selected from the group consisting of a sodium silicate having a molecular ratio $SiO_2$/alkali metal oxide of from 2.7 to 4.5 a potassium silicate having a molecular ratio $SiO_2$-/alkali metal oxide of from 2.5 to 5.0 a lithium silicate having a molecular ratio $SiO_2$/alkali metal oxide of from 2.0 to 5.5, and an alkali metal-ammonium silicate having a molecular ratio $SiO_2$/alkali metal oxide of from 2 to 9 and the hardening step which comprises gassing the molding composition with a dilute $CO_2$-gas essentially consisting of $CO_2$ and a gas which is inert towards alkali silicate wherein the $CO_2$- concentration is not more than 20 v/v%.

2. The molding process as defined in claim 1 wherein said alkali silicate binder has a molecular ratio of 2.7–4.5.

3. The molding process as defined in claim 2 wherein said alkali silicate binder has a molecular ratio of 3.0–4.5.

4. The molding process as defined in claim 1 wherein said alkali metal-ammonium silicate comprises a quaternary ammonium base represented by the formula

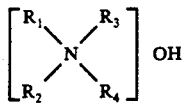

wherein $R_1$, $R_2$, and $R_3$ each represent alkyl or hydroxyalkyl containing 1–20 carbon atoms and $R_4$ represents alkyl containing 1–4 carbon atoms.

5. The molding process as defined in claim 1 further comprising the step of mixing said alkali silicate binder with at least one inhibiting agent selected from the group consisting of alkali-stabilized colloidal silica and a quaternary ammonium silicate.

6. The molding process as defined in claim 5 wherein the ratio of said alkali silicate to said colloidal silica is from about 100:0.1 to about 1:2 calculated on silica.

7. The molding process as defined in claim 5 wherein the ratio of said alkali silicate to said quaternary ammonium silicate is from about 100:0.1 to about 1:10 calculated on silica.

8. The molding process as defined in claim 5 wherein said ammonium silicate has a molecular ratio $SiO_2$/ammonium base anhydride of about 1/2–7.

9. The molding process as defined in claim 1 further comprising the step of mixing said alkali silicate binder with 0.1–30 w/w % of said alkali silicate of at least one inhibiting agent selected from the group consisting of a saccharide, a polysaccharide and a polyhydric alcohol.

10. The molding process as defined in claim 1 further comprising the step of mixing said alkali silicate binder with 0.1–30 w/w % of said alkali silicate of at least one inhibiting agent selected from the group consisting of glucose, invert sugar, sucrose, sorbitol and mannitol.

11. The molding process as defined in claim 1 further comprising the step of heating said dilute $CO_2$-gas to a temperature of not more than 100° C.

12. The molding process of claim 1 wherein said inert gas is dried air.

13. The molding process as defined in claim 1, wherein the $CO_2$-concentration of the dilute $CO_2$-gas is from more than the atmospheric $CO_2$ concentration to not more than 20% by volume.

14. An alkali silicate binder composition comprising the alkali silicate binder as defined in claim 1 and a quaternary ammonium silicate wherein the ratio of alkali silicate to ammonium silicate is from about 100:0.1 to about 1:10 calculated on silica.

15. The alkali silicate binder composition as defined in claim 14, further comprising colloidal silica wherein the ratio of alkali silicate to colloidal silica is from about 100:0.1 to about 1:2 calculated on silica.

* * * * *